US005211424A

United States Patent [19]

Bliss

[11] Patent Number: 5,211,424

[45] Date of Patent: May 18, 1993

[54] SECURE PASSPORT DOCUMENT AND METHOD OF MAKING THE SAME

[75] Inventor: Howard B. Bliss, Hyattsville, Md.

[73] Assignee: PRC Inc., McLean, Va.

[21] Appl. No.: 746,251

[22] Filed: Aug. 15, 1991

[51] Int. Cl.[5] ..... B42D 15/00

[52] U.S. Cl. ..... 281/15.1; 283/904

[58] Field of Search ..... 283/904; 281/15.1

[56] References Cited

U.S. PATENT DOCUMENTS 5,106,719 4/1992 Oshikoshi et al. ..... 283/904

FOREIGN PATENT DOCUMENTS 313084 4/1989 European Pat. Off. ..... 283/94

*Primary Examiner*—Paul A. Bell

*Attorney, Agent, or Firm*—Edward D. Murphy

[57] ABSTRACT

A machine readable passport document contains an unbound data page mounted in the document in a secure and tamper-resistant manner. The data page is printed as a separate sheet and contains a photographic image, bearer identification data and machine readable data, all imprinted on a single paper surface. The data page is mounted within the document by means of a heat activatable adhesive and is covered by a transparent sheet.

An improved method of assembling a passport document includes the use of a folder having a transparent sheet and a dry adhesive sheet. The data page is placed in the folder which is inserted into a bound passport booklet. The booklet is then heated and compressed to mount the data page in the document. Visa data pages are mounted in the same manner.

5 Claims, 2 Drawing Sheets

SECURE PASSPORT DOCUMENT AND METHOD OF MAKING THE SAME

BACKGROUND OF THE INVENTION

The present invention relates to a passport document wherein individualized data is mounted in the document in a secure and tamper-resistant manner.

Passport documents are used by most countries to establish the bearer's identity and to provide diplomatic protection when crossing borders or travelling in foreign jurisdictions. However, passport documents of the type currently in use are relatively insecure in that they can be modified by skilled forgers for use by individuals other than those to whom they were originally issued. For example, it can sometimes be difficult to detect the skillful removal and replacement of the photograph used in present U.S. passport documents.

In an attempt to overcome these difficulties and to provide a more secure and tamper-resistant passport document, it is desirable to use digital printing processes which would permit a single paper surface within the document to contain a photograph of the bearer, human-readable information such as name, birth date, birth place, etc. and machine readable encoded data which could be used by computer scanners at passport control points to provide quick call up of pertinent information about the bearer from a memory.

Unfortunately, this leads to a further difficulty in that passport booklets are produced in quantity in standard form. Specific data concerning the bearer is only added at the last moment when one specific booklet is being issued to an individual. However, no machines are presently available which can form all of the necessary information on a single page within a previously bound booklet. To implement such a process, it is therefore necessary to form the data on a separate data page which must then be permanently and nonremovably mounted within the passport booklet.

This process is, however, complicated by the fact that known methods for mounting such a single sheet are not adequate. For example, the standard for the location of machine readable data in a passport document requires the accurate positioning of the data within dimensional tolerances which simply cannot be achieved by many processes. In some methods, the resistance to forgers is not sufficient. In other cases, the heat of the imprinting process for the data either prevents the use of heat activated adhesives which might otherwise be used to mount the data sheet, or requires the use of high temperature adhesives. However, high temperatures cause further complications with other elements of the passport document such as removal of the gold leaf which is normally desirable on the cover of the passport.

SUMMARY OF THE INVENTION

Accordingly, it is an object of the present invention to provide an improved, tamper-resistant passport document.

It is a further object of this invention to provide for the incorporation of a separate page containing unique data in to a previously bound volume in a substantially non-removable manner.

In a preferred embodiment, this invention contemplates the provision of a passport document which includes a front and back cover and a plurality of pages bound within the cover. The document of this invention further includes an unbound data sheet including specific data formed thereon such as a visual image and verbal data descriptive of an individual. The data sheet is bonded to a surface in said document via a heat activated adhesive. A transparent laminate is bonded in place via a heat activated adhesive layer over the top of the data sheet to complete the structure.

The invention further contemplates a method of incorporating a separate unbound data page containing individualized data into a bound booklet such as a passport document by providing a transparent laminate sheet having a heat activated adhesive on one side thereof, providing a heat activated adhesive layer, joining the laminate sheet and the layer to form a folder wherein the adhesive-coated side of the laminate sheet faces the adhesive layer, placing the data page in the folder, placing the folder in the bound booklet so that the adhesive layer faces a page of the booklet and so that the data thereon is accurately located relative to the edges of the booklet, and placing the booklet containing the folder and the data sheet into a press at a pressure-time-and-temperature combination sufficient to activate the layers of adhesive to bond the laminate sheet to the data page and to bond the data page to the page in the booklet.

This invention further contemplates the provision of a mounting folder to be used for non-removably mounting an unbound page into a bound booklet such as a passport document, the folder including a sheet of transparent laminate having a heat activated adhesive on one surface, and a paper support sheet having heat activated adhesive coatings on both the front and back surfaces thereof, the laminate and the support sheet being joined along one edge to form the folder.

DETAILED DESCRIPTION

With reference now to FIGS. 1–5, the following is a detailed description of the preferred embodiment of this invention.

Figure 1:
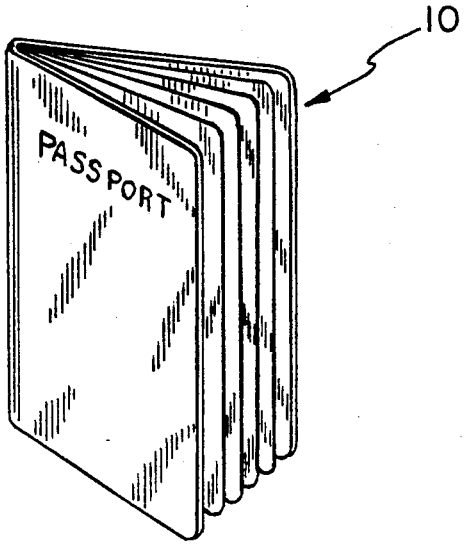
FIG. 1 is a perspective view of a passport document.

FIG. 1 illustrates a typical passport document 10 of the type comprising several pages made of paper bound within a durable cover such as vinyl. The present invention is particularly concerned with machine readable passports of the type defined in the International Civil Aviation Organization DOC 9303/2 entitled "Machine Readable Passports Second Edition-1990", which document has also been approved by the International Standards Organization. This document sets forth in considerable detail the internationally agreed standards for machine readable passports which are intended to facilitate the movement of international passengers through clearance controls, particularly at airports. One aspect of particular importance in the standard is the accurate placement of machine readable data in a specified location on a page.

Figure 2:
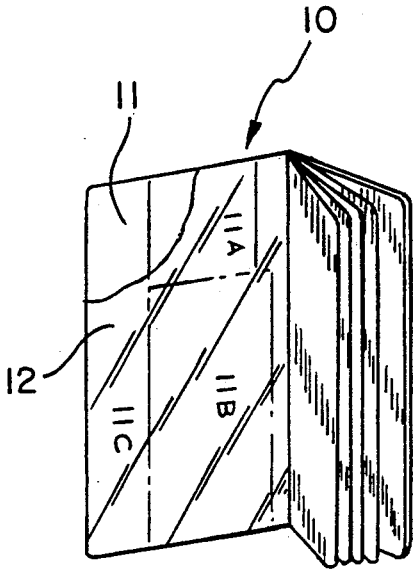
FIG. 2 is a perspective view of a passport document according to the present invention showing the individual data page on the inside of the front cover.

FIG. 2 illustrates the passport 10 of FIG. 1 opened to show the inside surface of the front cover which comprises elements assembled in accordance with the present invention. More specifically, the structure includes a data page 11 covered by a transparent laminate sheet 12. The sheet 12 is partially broken away in one corner. The data page comprises a photographic zone 11A, a bearer data zone 11B and a machine readable zone 11C, all of which are arranged in accordance with standards set forth in ICAO DOC 9303/2. In accordance with the present invention, the information contained on the data page 11 is imprinted thereon prior to the assembly of the page into the passport document 10.

Figure 3:
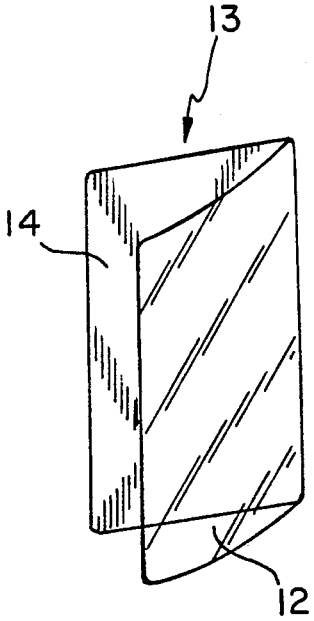
FIG. 3 is a perspective view of a data sheet mounting folder in accordance with the present invention.

To achieve the assembly shown in FIG. 2, a folder 13 as illustrated in FIG. 3 is utilized. The folder 13 comprises a front page which is made up of the transparent laminate sheet 12 of polyester, one surface which has been coated with a heat activatable adhesive such as polyolefin. The second page 14 of the folder 13 comprises a sheet of paper coated on both sides with the same heat activatable adhesive.

The pages 12 and 14 are manufactured separately, preferably in sheets, which are then cut into suitably sized pages. These pages are then joined to form folder 14 by applying pressure to a narrow area along an edge of the pages for a time and at a temperature sufficient to activate the adhesive along the edge to create a bonded joint, thus forming the folder 13.

Figure 4:
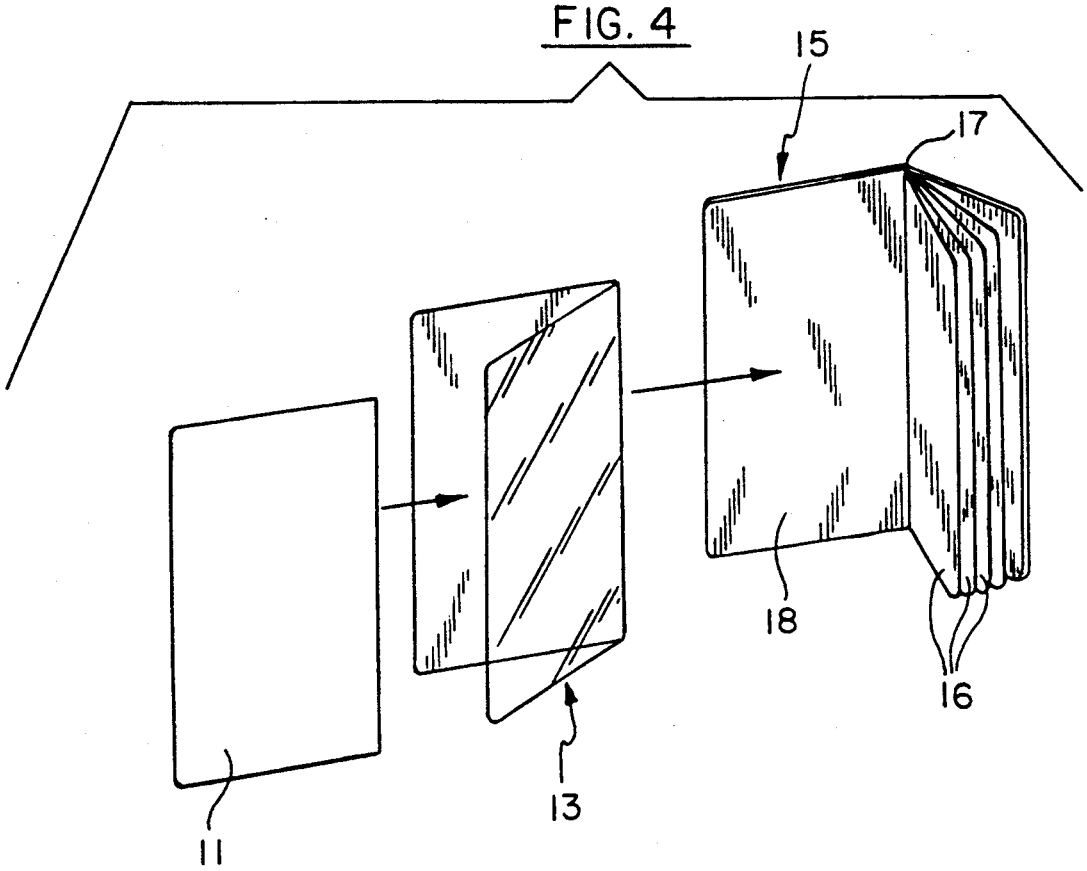
FIG. 4 is an exploded view illustrating the manner of assembling a passport document in accord with the present invention.

To create the passport document 10, a large quantity of booklets 15, as illustrated in FIG. 4, are mass produced to be distributed to passport issuing offices. The booklets 15 may typically comprise a plurality of pages 16, bound along an axis 17. In the usual case, single sheets are cut to the size of two pages. The sheets are folded along a center line and then stitched together with thread. The first page 18 and the last page of the booklet are covered with a suitable material such as vinyl which will provide adequate appearance and durability. The vinyl is slightly enlarged at the binding 17 to allow for opening and closing the document. Typically, the word "passport", the seal of the country and the name of the country issuing the passport are embossed in gold on the front cover of the booklet 15.

When a passport is to be prepared and issued to an individual, the issuing office enters the appropriate data, including a photographic image, specific identification data, and selected data which is to be machine readable, into a suitable printing system such as a computer/laser printer combination. The data page 11 is then printed so that all of the desired information including the photographic image is imprinted on a single sheet of paper. Data page 11 is then trimmed to size or it may be precut to size. The issuing office simply assembles the data page 11 into the folder 13 with the imprinted data visible thru the transparent laminate and inserts this combination inside the front cover of a passport booklet 15 with the paper page 14 facing the first page 18 of the booklet. The booklet is then passed through a press which provides a suitable combination of heat, pressure and time to activate the various layers of heat activatable adhesive. For example, conventional laminating presses apply a pressure in the range of 40–50 psi for a period of about 30 seconds while the document is passed through a heating chamber which raises the temperature of the adhesive to about 220° F. to liquify the adhesive.

As the adhesive liquefies, it permeates the first page 18 of the passport booklet, the back page 14 of the folder 13 and the data page 11. Since the back page 14 and the data page 11 are exposed to adhesive on both sides, adhesive permeates these pages from both sides. The transparent laminate 12 and the first page 18, of course, are exposed to adhesive on one side only.

Figure 5:
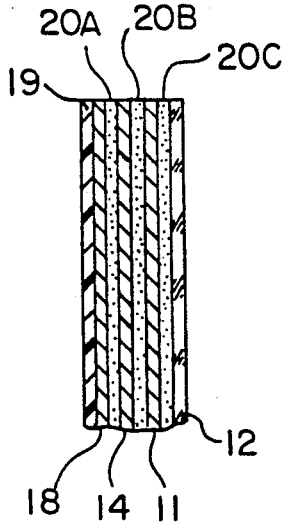
FIG. 5 is a cross-sectional view of the cover and data page of a passport document.

When the passport 10 is removed from the press, the data page 11 is securely bonded in place between the vinyl cover and first page 18 of the booklet on one side and the transparent laminate 12 on the other. Overall, the layered structure produced is shown in FIG. 5 wherein the cross-section of the vinyl cover is identified as 19, and the heat activatable adhesive layers are identified as 20A, 20B and 20C. Another layer of adhesive between the cover 19 and the first page 18 is not shown as it forms no part of this invention. Although these layers are shown as discrete in the view of FIG. 5, which of course is not to scale, in an actual document, the paper may be so permeated with adhesive so that the thin layers are virtually indistinguishable. Of course, this is exactly the purpose of the process disclosed herein since it makes the data page very difficult, if not impossible, to remove for purposes of alteration.

Thus, the completed document provides a single thickness data page 11 on which all desired information concerning the bearer is directly imprinted and which is mounted into the passport booklet via the adhesive layers. To further discourage tampering, holographic structures and other known security devices may be incorporated in the transparent laminate or elsewhere so as to reveal alterations by their resultant change, thus creating a virtually tamper-proof document.

The ICAO is also in the process of developing standards for visas which will be virtually identical to those for the data page 11 except for the information contained thereon. To prevent tampering with visa documents, it is also desirable that the visas be permanently mounted within the passport booklet, on some page other than the first page 18.

The process and structure of the present invention are also entirely suitable for mounting a visa in a previously issued passport in exactly the same manner as has been described above. After the visa-related information has been imprinted on a data page 11 which consists of a single sheet of paper, the visa page is inserted into a folder 13 which is, in turn, inserted into the passport so that the one adhesive coated surface of page 14 rests against one of the internal booklet pages 16. Passage of the document containing the new folder and visa through a suitable similar heat and pressure operation then activates the adhesive and permanently bonds the visa to the selected page of the booklet.

In the case of either a passport data page or the similar visa data page, a critical element of the ICAO passport standard is that the machine readable data appear at exactly the same location in every passport. In fact, the very close tolerances involved as set forth in detail in DOC 9303/2 require that this data be accurately located within one mm. (four hundredths of an inch) of the nominal location.

As previously noted, many prior methods of mounting data pages may provide adequate results some of the time but the percentage of erroneous location is in fact unacceptably high. While it is well known to produce accurately formatted data pages containing all required data including the photographic image imprinted on a single paper surface, this can only be done on a unmounted single sheet of paper. However, since this cannot be done on a surface contained within a multipage booklet, the inaccuracies inherent in the prior mounting methods and passport constructions override the accuracy of the printer and the document cannot be read by machine as required.

In contrast, the structure of the present invention provides for mounting of the data page in exactly the proper location every time. This is achieved by precisely cutting the pages of the folder 13 and of the data page 11 to the exact dimensions required and by imprinting the data at precisely determined locations relative to the boundary of the data page. The method and structure of this invention then permit entirely accurate placement of the mounted data page by simply forming the assembly shown in FIG. 4, tapping the edges of the booklet against a hard flat surface to align the elements 11 and 13 with the booklet 15 and then subjecting the assembly to the heat, pressure and time combination as described above. Thus, this method and structure permits the rapid assembly of completed passports with an extremely high level of accuracy in the placement of the information on both the inside cover of the passport and on interior pages thereof.

Figure 6:
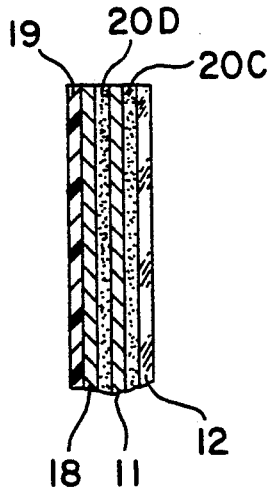
FIG. 6 is a cross-sectional view of an alternative embodiment of this invention.

Of course, various modifications and improvements may be made in the method and structure of this invention while still remaining within the spirit and scope thereof. For example, the paper page 14 of the folder 13 is actually present only to serve as a retaining structure to hold the layers of heat activatable adhesive on its front and back surfaces. Thus, this page could be replaced by a self-supporting structure of only heat activatable adhesive which would then be the only intermediate layer between the selected page of the passport booklet and the data page 11. This embodiment is shown in FIG. 6 wherein the self-supporting adhesive structure is identified as 20D. The method of assembly is the same as that shown in FIG. 4. In anther less desirable alternative, the folder 13 could be applied directly to the vinyl cover 19. Accordingly, it is intended that all such modifications and improvements be included within the scope of the claims set forth below.

What is claimed is:

1. A mounting folder for permanently mounting a page containing unique information into a standard bound passport document, said folder comprising a sheet of transparent plastic laminate having a dry coating of heat-activatable adhesive on one surface thereof;

a paper support sheet having front and back surfaces;

dry coatings of heat-activatable adhesive on both of said front and back surfaces thereof;

said laminate and said support sheet being bounded together along one edge thereof to form a folder, said coated surface of said laminate facing toward one surface of said support sheet.

2. A passport document comprising a cover;

a plurality of internal pages bound within said cover;

said cover and said pages each having two surfaces;

a separate, unbound single data page containing unique data which distinguishes said passport document from others;

said data page being bonded to one of said surfaces within said passport document by means of a first layer of heat activated adhesive between said one surface and said data page; and a transparent plastic laminate sheet bonded to said data page by means of a second layer of heat activated adhesive located therebetween;

said adhesive layers and said laminate sheet affixing said data page in said passport document in a tamper-resistant manner.

3. A passport document comprising a front and back cover page;

a plurality of internal pages bound within said cover page;

a separate, unbound single data page containing unique photographic and other data descriptive of a specific individual;

said data page being bonded to one of said internal pages within said passport document through a multiple layer structure comprising a first layer of heat activated adhesive adjacent said one of said internal pages;

a paper support sheet; and a second layer of heat activated adhesive between said support sheet and said data page; and a transparent plastic laminate sheet bonded to said data page by means of a third layer of heat activated adhesive located therebetween;

said adhesive layers and said laminate sheet nonremovably affixing said data page in said passport document.

4. A method of permanently mounting a single page containing data formed thereon into a bound volume comprising the steps of:

providing a transparent plastic laminate sheet having a dry heat-activatable adhesive on one side thereof;

providing a paper support sheet having a dry heat-activatable adhesive on both sides thereof;

joining said laminate sheet and said support sheet along one edge thereof to form a folder, said laminate sheet being oriented so that the side having said adhesive faces said support sheet;

placing said data page into said folder;

placing said folder into the bound volume so that said support sheet faces a page of said volume; and passing said volume through a press at a pressure-time-and-temperature combination sufficient to activate said adhesive to bond said data page to said laminate sheet and to said page of said volume, to permanently mount said data page in said bound volume.

5. A method of mounting an unbound data page in a bound passport document comprising the steps of:

providing a passport document including a cover and a plurality of pages bound therein, said cover and said pages each having two planar surfaces;

providing a layered structure adjacent one of said planar surfaces, said structure including a data page comprising a planar surface bearing information in machine-readable form;

a transparent laminate sheet; and activatable adhesive layers disposed between said one planar surface and said data page, and between said data page and said laminate sheet;

positioning said data page so that said machine-readable data is located within one millimeter of a predetermined location on said planar surface; and activating said adhesive layers to bond said data page in said position in a tamper-resistant manner.

* * * * *